United States Patent [19]

Alinder et al.

[11] 4,009,908

[45] Mar. 1, 1977

[54] CARPET AND TILE STRIPPER

[75] Inventors: Gilbert L. Alinder; Lloyd E. Anderson, both of Minneapolis, Minn.

[73] Assignee: Taylor Manufacturing, Inc., City of Industry, Calif.

[22] Filed: Oct. 20, 1975

[21] Appl. No.: 623,902

[52] U.S. Cl. ..... 299/37; 30/169; 15/93 R

[51] Int. Cl.[2] ..... A47L 11/12

[58] Field of Search ..... 30/170, 169; 299/37; 15/93 R

[56] References Cited

UNITED STATES PATENTS

| | | | |
|---|---|---|---|
| 3,376,071 | 4/1968 | Stein | 299/37 |
| 3,377,702 | 4/1968 | Aspeek | 30/169 |
| 3,733,637 | 5/1973 | Becker | 299/37 X |

*Primary Examiner*—Al Lawrence Smith
*Assistant Examiner*—J. C. Peters
*Attorney, Agent, or Firm*—Schroeder, Siegfried, Ryan & Vidas

[57] ABSTRACT

A carpet and tile stripper is disclosed which has a blade member mounted to a power-driven oscillating member so that the blade pivots about a shaft in axial alignment with the direction of travel of the carpet stripper. The extent of rotation of the blade is about 10°–20°. The blade oscillates at a high rate of speed providing a shearing action at the blade tip that rapidly and cleanly removes bonded carpet or tile from the floor.

10 Claims, 3 Drawing Figures

CARPET AND TILE STRIPPER

The present invention is directed to carpet and tile stripping machines and in particular to such machines which are intended to be used by a single operator to remove carpet or tile that has been bonded to the floor. During the discussion which follows, the machine will be described in connection with the removal of carpeting, although it should be understood that the apparatus is equally adaptable to the removal of asphalt, vinyl and other types of tile materials that are bonded to a floor.

The prior art machines for accomplishing this purpose have relief upon a reciprocating motion of the blade member perpenddicular to the cutting edge to remove tile and other materials from a floor. Typical of many of these earlier machines in the type shown in U.S. Pat. No. 3,251,629. In this patent's teaching, the blade member is angled so as to get under the edge of carpeting or other material and then the blade member is moved in a reciprocal manner with the direction of travel being along the axis of movement of the overall machine so that essentially a pounding action of the blade member perpendicular to the cutting edge to U.S. Pat. No. 3,906,514 shows a variation of this type of reciprocating blade motion wherein a plurality of blade members operating on drive cams perform a similar function.

The present invention constitutes an improvement over the reciprocating blade type actions in its use of an oscillating motion of the blade about a shaft in axial alignment with the normal motion of the overall machine. The blade is angled so as to bear against the floor with the blade edfes traveling through an oscillating arcuate path which is typically in the range of about 10°–20°. This oscillating motion produces a shearing action which rapidly and cleanly lifts the carpeting from the substrate to leave a relatively clean floor when compared to the prior art machines. The market acceptance of machines utilizing the principle of the invention has been rapid and is brought about at least in significant degree by the much more rapid removal of materials than with blades of the reciprocating type.

The invention will be best understood in connection with the following drawings wherein:

IN THE DRAWINGS

Figure 1:
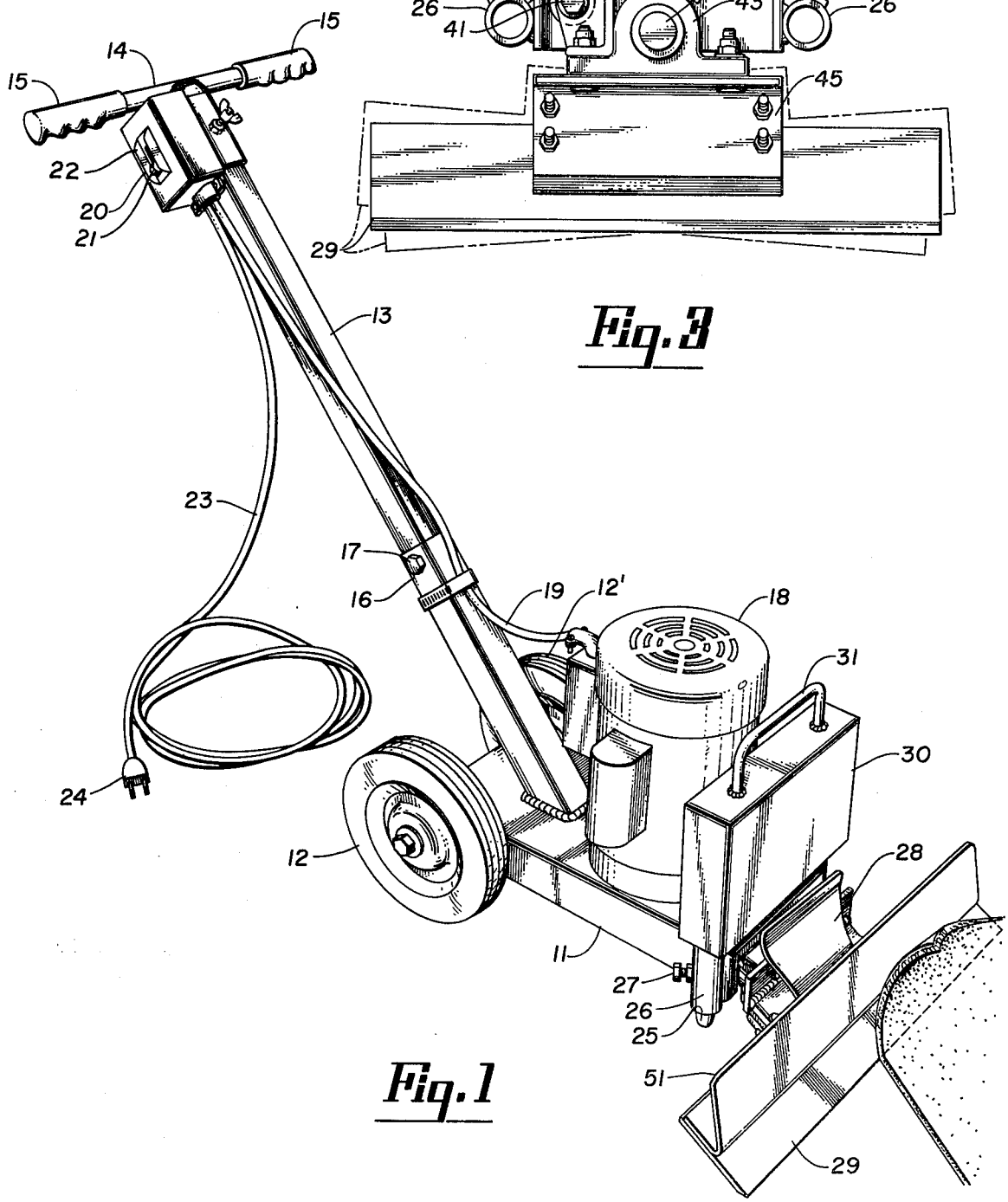
FIG. 1 is a perspective view of a machine in accordance with the invention showing it in actual operation removing carpeting from a floor.

Referring first to FIG. 1, there is shown in perspective view an apparatus in accordance with the invention. This apparatus includes a base frame member 11 from which are mounted two wheel members 12 and 12' on opposite sides thereof adjacent the rear portion. A handle member 13 is welded to member 11 and extends rearwardly therefrom at an angle as shown and terminates at the upper end thereof at a cross piece 14 which may be conveniently provided with hand grip members 15. Handle 13 is desirably formed of telescoping sections as at 16 so that the length of the handle can be adjusted to the individual workman's discretion. This is readily accomplished by having handle 13 telescope into a somewhat larger member 16 with holes drilled through both 13 and 16 so they are held in fixed relationship by means of peg. 17.

An electric drive motor 18 is mounted to frame 11 and has its shaft extending therethrough for driving mechanism which will be described. Electric motor 18 is connected by means of power cord 19 to a switch box 20 conveniently located adjacent handle member 14. As the overall apparatus produces a significant amount of vibration during its operation, the switch member 21 is recessed between a pair of guard members 22 to shield it from being accidentally turned on or off by the operator. A second cord 23 is provided with a male plug 24 for insertion into a normal wall outlet. This provides the power for electric motor 18.

At the forwardmost portion of plate 11, there is provided a removable weight 30 with a handle 31. The function of weight 30 is to provide extra bearing weight against the blade tip of the machine so as to hold it in positive engagement with the floor during the operation of the machine and to provide an inertial mass to inhibit transverse motion of the whole forward end of the machine during osicllatory motion of the blade and blade holder assembly. The weight of motor 18 also provides similar function. It is desirable to have the motor 18 as far forward as possible on frame 11. For clarity in the drawings the motor 18 is shown womewhat more to the rear than is the preferred position. In some instances, weight 30 will not be needed so it is provided with a pair of extending rod members 25 which are of a size to pass through tube members 26. Members 26 are welded or otherwise joined to frame 11. A set screw 27 is provided to positively lock weight 30 into position when it is utilized.

At the forwardmost end of the machine, there is provided a mount assembly 28 which has removably joined thereto a blade member 29. Blade member 29 is intended for an oscillatory motion through the arcuate motion of mount 28 and as is illustrated by the dotted line showing the extent of the arcuate motion of blade 29. The manner of producing the desired oscillating arcuate motion will now be described with regard to FIGS. 2 and 3. The arcuate motion will desirably be from about 10°–20° over its travel.

Figure 3:
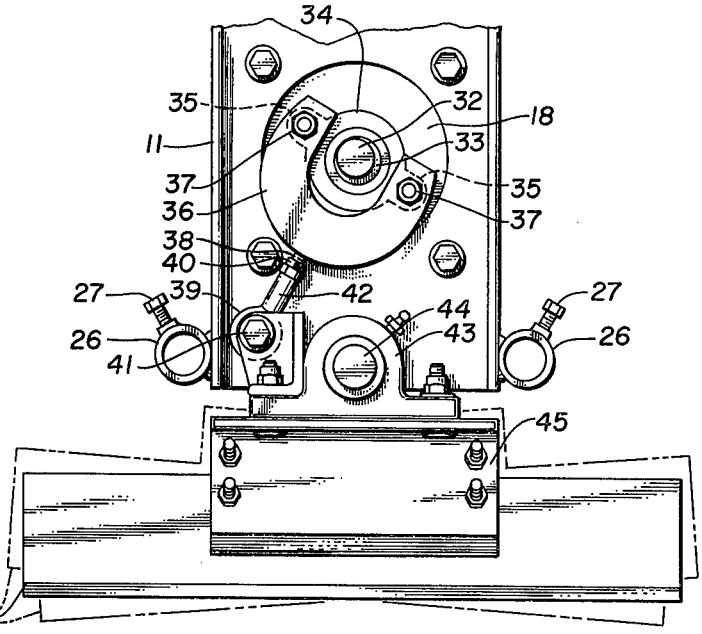
FIG. 3 is a bottom plan view of the drive mechanism in accordance with the invention.
Figure 2:
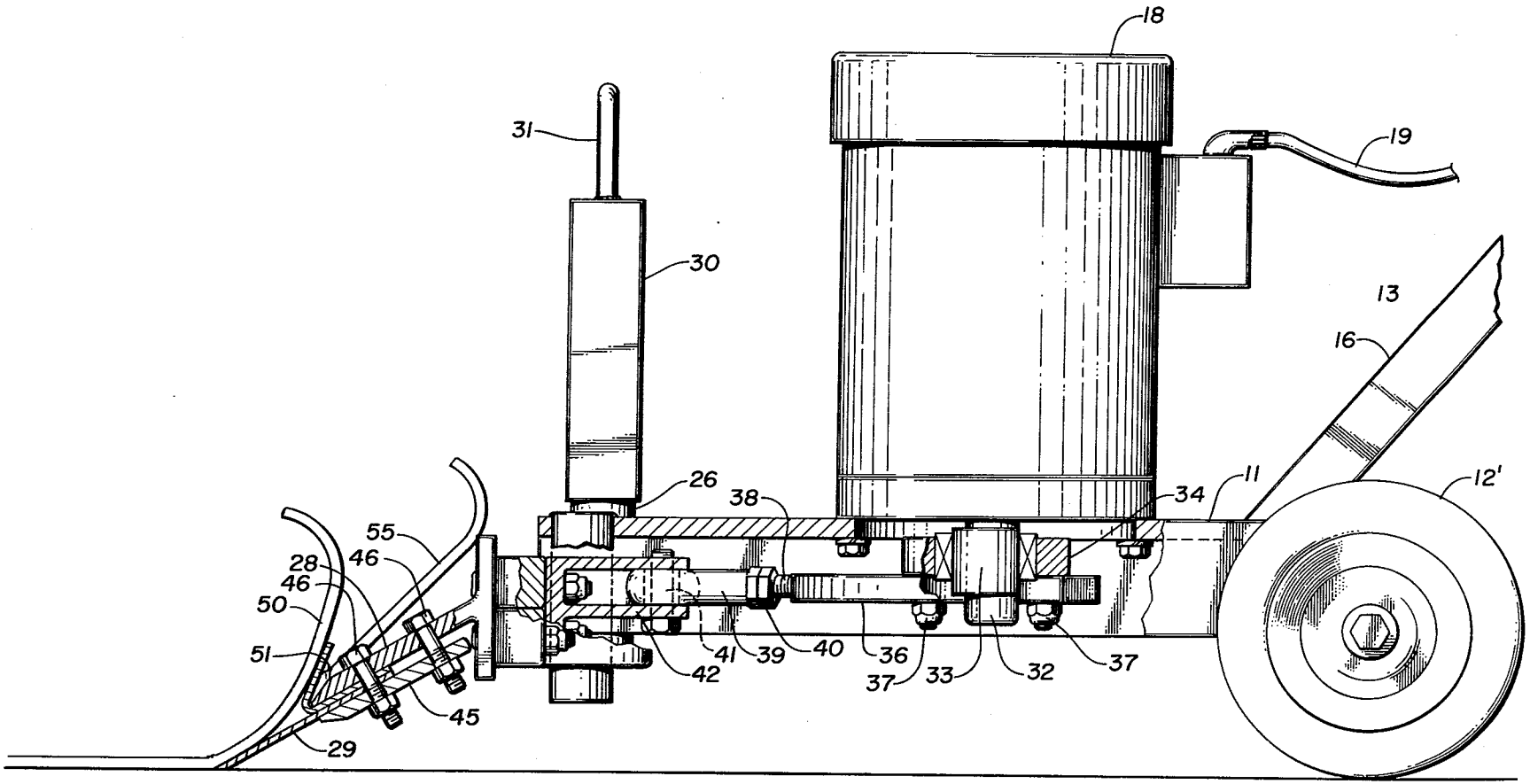
FIG. 2 is a side-elevational view with portions of the machine of FIG. 1 cut away for purposes of showing the internal relationship of the moving parts.

As can be seen in FIGS. 2 and 3 where like parts are given the same numerical designation as in FIG. 1, motor 18 has it shaft rotatably passing through mounting plate 11. The drive motor shaft 32 has joined thereto a cam member 33. Cam member 33 is fixedly joined to shaft 32 and consists of a circular disc with shaft 32 passing therethrough off center so as to create a camming member. The camming member 33 is in journaled engagement awith generally circular member 34 which has projecting from opposite sides thereof ear members 35. Ear members 35 are joined ato a clevis member 36 by means such as bolts 37.

Clevis member 36 is of a generally Y-shaped construction having projecting from the mid-point of the end opposite from the arms thereof a threaded member 38 which is joined to a spindle or atie arm 39. The purpose in threading of member 38 is to provide a lineal adjustment of the extent to which member 38 is in engagement with member 39. A lock nut 40 holds the members in position once this degree of engagement is set. Rotationally extending through the end of spindle arm 39 is a shaft 41 which is mounted to a bracket 42 comprising a portion of a blade supporting assembly 43. Member 43 in turn is mounted for partial rotation abouta shaft 44 (not shown in FIG. 2 for reasons of showing tie rod arm 39 and bracket 42) together with shaft 32. Drive shaft 32 and shaft 44 are in alignment along the direction of motion of the machine when in use.

Joined to member 43 is a blade mounting assembly 28. Member 28 includes a blade clamping member 45 which is joined to member 28 by means of bolts 46 which pass through holes in members 28, 45 and blade 29 so as to clamp blade member 29 therebetween. The angle of the blade clamping forward portion of member 28 is in accordance with the desired angle that one wishes to have for blade member 28 for its engagement with the surface beneath the carpet and at the floor. Generally speaking, this angle will be at about 30° to the angle of the floor during the cutting operation. As can be seen, the tip of blade 29 is beveled so as to be self sharpening in use and to function in an efficient manner so as to lift the carpeting 50 from the floor in the manner schematically shown in FIGS. 1 and 2. A metal plate member 51 bent back upon itself to form an acute angle is desirably included with the blade mounting assembly. Member 51 by reason of the bent configuration and its extension across the length of blade 29 stiffens the blade against flexing. Also, as seen in FIG. 2 it aids in starting the curve of carpet 50 as it is cut so it forms a roll as it is being cut.

Member 28 is desirably strengthened by a member 55 which is shown only on FIG. 2. Member 55 is welded to the toe and uppermost end of member 28 and is desirably of a width to span the space between bolts 46 leaving ready access to these bolts. As shown, the upper portion of member 55 is curved to further induce roll forming of carpet 50 as it is cut should it not start to roll at stiffener 51.

The operation of the device is now believed apparent. The operator places the machine so that blade 29 is in engagement with the floor adjacent the edge of the carpeting to be removed. Dependent upon the desire of the operator and the nature of the material to be removed from the floor, he may made use of weight 30 to aid in holding down the forward edge of the machine and the blade 29 into contact with the floor. Switch 21 is then turned on and the following action ensues. Shaft 32 begins to rotate along with cam member 33. The rotation of the cam member 33 which is fixedly joined to shaft 32 brings about an oscillatory motion of member 34 thereby moving clevis member 36 in a partially oscillating and partially reciprocating mode so as to move by means of members 38 and 39 and shaft 41 the assembly 43 in an arcuate manner about shaft 44 through the extent of travel as previously discussed. This arcuate motion is of course transmitted from assembly 43 to blade holding assembly 28 to blade 29 thereby producing the desired shearing action beneath the carpeting. The operator need merely wheel the machine in a forward manner with the blade 29 in firm engagement with the floor to produce a rapid and efficient lifting of the carpeting adjacent the blade from the floor. As already noted, the arcuate motion of the blade has a tendency to keep the blade sharp and thus advantageously decreases the number of blade changes required in extended use.

Various modifications can be made to the apparatus. For example, where desired, one may stiffen blade 29 by use of various stiffening members. Although not required, the use of stiffening amember 51 is advantageous so that blade 29 may be kept relatively thin. The stiffening action of member 51 permits this.

We claim:

1. A power operated carpet and tile stripping machine comprising: a. a supporting frame;

b. motor means supported on said frame, said motor means including a cam means driven by said motor means;

c. a pair of wheels rotatably mounted to the rear porition of said frame;

d. a handle bar for guiding and maneuvering said machine attached to said frame;

e. cutting blade mounting head pivotably mounted to the forward portion of said machine on a shaft for partial rotation about an axis generally vertical to the floor, said head having the blade mounting portion thereof extending outwardly therefrom to form an acute angle with said floor; and f. connecting means linking said cam means to said mounting head means so as to produce an oscillating arcuate motion of said head means.

2. A machaine in accordance with claim 1 wherein a cutting blade is mounted to and extends outwardly from said head means so as to have its cutting edge exposed adjacent the floor.

3. A machine in accordance with claim 1 wherein the oscillating arcuate motion is about 10°.

4. A machine in accordance with claim 1 wherein said connecting means is a tie rod having one end thereof joined in journaled relationship to said mounting head adjacent one end thereof with the opposite end of said connecting means in operative engagement with said cam means.

5. A power operated carpet and tile stripping machine comprising:

a. a supporting frame;

b. motor means supported on said frame;

c. rotational frame support means rotatably mounted to the rear portion of said frame;

d. a cutting blade mounting ehead pivotally mounted to said frame at the forward portion thereof on a shaft for partial rotation about an axis generally vertical to the floor, said mounting head including means for mounting a cutting blade at the forward portion of said head to form an acute angle with the floor; and e. oscillating linking means in driven relationship with said motor means and joining said motor means to said mounting head so as to produce an oscillatory arcuate motion of said mounting head of from 10 to 20° about the pivotal mount for said mounting head.

6.A machine in accordance with claim 5 wherein said motor means is an electric motor and said oscillating linkage means includes a cam assembly driven by said motor with the surface of said cam member in operative engagement with a cam follower joined to said mounting head at a point remote from the pivotal mount for said mounting head

7. A mcahine in accordance with claim 1 wherein a removable weight is joined to said frame at the region adjacent said mounting head to aid in holding the cutting blade in engagement with the floor and to provide an inertial mass to reduce any tendency fro the machine to move transversely to the forward direction of the machine in response to the oscillatory motion of the mounting head and blade.

8. A machine in accordance with claim 1 wherein said motor means is an electric motor having a drive shaft and said cam means is a cam member mounted to the shaft of the motor for rotation therewith.

9. A machine in accordance with claim 8 wherein said connecting means is a tie rod joined in journaled relationship at one end thereof to said mounting head at a point remote from the pivotal mount and which is joined at the opposite end thereof in operative engagement with said cam member.

10. A machine in accordance with claim 9 wherein a cutting blade is mounted to said mounting head means and a blade stiffening member is joined to said blade and extends parallel to and along the length of the cutting edge of said blade.

* * * * *

UNITED STATES PATENT OFFICE

CERTIFICATE OF CORRECTION

Patent No. 4,009,908 Dated March 1, 1977

Inventor(s) Gilbert L. Alinder et al.

It is certified that error appears in the above-identified patent and that said Letters Patent are hereby corrected as shown below:

Column 1, line 15: "relief" should be --relied--.

Column 1, line 16: "perpenddicular" should be --perpendicular--.

Column 1, line 25: "member perpendicular to the cutting edge to" should be --beneath the carpet or the material is the result--.

Column 2, line 28: "womewhat" should be --somewhat--.

Column 2, line 54: "awith" should be -- with--.

Column 2, line 56: "ato" should be --to--.

Column 2, line 61: "atie" should be --tie--.

Column 3, line 2: "abouta" should be --about a--.

UNITED STATES PATENT OFFICE

CERTIFICATE OF CORRECTION

Patent No. 4,009,908 Dated March 1, 1977

Inventor(s) Gilbert L. Alinder et al.

It is certified that error appears in the above-identified patent and that said Letters Patent are hereby corrected as shown below:

Column 4, line 41: "ehead" should be --head--.

Column 4, line 61: "mcahine" should be --machine--.

Column 4, line 65: "fro" should be --for--.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*